US007546711B2

(12) United States Patent
Sälzer

(10) Patent No.: US 7,546,711 B2
(45) Date of Patent: Jun. 16, 2009

(54) EXPLOSION-RESISTING WINDOW

(75) Inventor: Heinrich Sälzer, Marburg (DE)

(73) Assignee: Sälzer Sicherheitstechnik GmbH, Marburg (DE)

( * ) Notice: Subject to any disclaimer, the term of this patent is extended or adjusted under 35 U.S.C. 154(b) by 714 days.

(21) Appl. No.: 10/947,402

(22) Filed: Sep. 22, 2004

(65) Prior Publication Data

US 2005/0102933 A1 May 19, 2005

(30) Foreign Application Priority Data

Sep. 22, 2003 (DE) ..... 103 44 168
Mar. 9, 2004 (DE) ..... 10 2004 011 767

(51) Int. Cl.
*E06B 3/00* (2006.01)

(52) U.S. Cl. ..... 52/204.5; 52/204.66; 52/204.51; 49/246; 49/21; 49/400

(58) Field of Classification Search ..... 52/204.5, 52/204.51, 204.6, 204.66; 49/246, 339, 346, 49/141, 21, 400, 402
See application file for complete search history.

(56) References Cited

U.S. PATENT DOCUMENTS

| | | | | |
|---|---|---|---|---|
| 4,625,659 | A | 12/1986 | Saelzer | |
| 4,630,411 | A | 12/1986 | Sälzer | |
| 5,767,493 | A | 6/1998 | Lautenschläger | |
| 6,167,656 | B1 * | 1/2001 | Devlin et al. | 49/463 |
| 6,185,882 | B1 * | 2/2001 | Pearson | 52/204.5 |
| 6,319,571 | B1 | 11/2001 | Anglin, Jr. | |
| 6,843,023 | B2 * | 1/2005 | Liu | 49/143 |
| 2001/0005962 | A1 * | 7/2001 | Emek | 52/204.5 |
| 2002/0166298 | A1 * | 11/2002 | Emek | 52/208 |

FOREIGN PATENT DOCUMENTS

| | | | |
|---|---|---|---|
| DE | 3420 883 | C2 | 2/1985 |
| DE | 3432 021 | C2 | 3/1986 |
| DE | 36 43 192 | | 7/1988 |
| DE | 37 22 965 | C1 | 2/1989 |
| DE | 38 17 966 | | 12/1989 |
| DE | 295 14 070 | | 11/1995 |
| DE | 298 04 797 | U1 | 6/1998 |
| DE | 299 09 593 | | 10/1999 |
| DE | 199 16 338 | C2 | 10/2000 |
| DE | 201 02 942 | U1 | 11/2001 |
| DE | 101 64 212 | A1 | 7/2003 |

(Continued)

*Primary Examiner*—Richard E Chilcot, Jr.
*Assistant Examiner*—Anthony N Bartosik
(74) *Attorney, Agent, or Firm*—Collard & Roe, P.C.

(57) ABSTRACT

An explosion-resisting window with a window frame and a sash frame, which accommodates a panel and is mounted in hinges on the window frame, so as to be tiltable, the sash frame nesting in the window frame in closed position. In order to obviate the need for an outer front glazing of armored glass while guaranteeing adequate safety against explosion shocks and permit the function of continuous ventilation if necessary in open position of the sash frame, the panel is made of armored glass and the window is provided with at least one tilt-limiting element, by means of which explosion-induced tilting of the sash frame in the hinges beyond a tilt-limit position can be resisted. There is at least one shift-limiting element, by means of which explosion-induced shifting of the sash frame perpendicular to a tilt axis in the hinges can be resisted.

5 Claims, 16 Drawing Sheets

FOREIGN PATENT DOCUMENTS

| | | |
|---|---|---|
| FR | 1 399 071 | 6/1964 |
| GB | 2 101 192 | 1/1983 |
| GB | 2 282 850 | 4/1995 |
| GB | 2 335 456 | 9/1999 |
| WO | WO 96/21075 | 7/1996 |

* cited by examiner

1'
2'
3'
5'
7'
8'
9'
10'
11'
12'
13'
14'
15'
16'
17'
18'
19'
20'
21'
22'
23'
24'
25'
26'
27'
28'
29'
II
III

EXPLOSION-RESISTING WINDOW

BACKGROUND OF THE INVENTION

The invention relates to an explosion-resisting window with a window frame and a sash frame, which accommodates a panel and is mounted in hinges on the window frame, so as to be tiltable around at least one axis, the sash frame nesting in the window frame in closed position.

"Tiltable" and "tilting" within the meaning of the present application are to be understood as turning between swiveling of the window frame around an arbitrary axis. In this application, the meaning of the term "tilting" encompasses not only classical "tilting" around a horizontal axis of rotation at the bottom of the sash frame but also, for example, "tipping" around a horizontal axis of rotation at the top of the sash frame or "turning" around a vertical axis of rotation. In particular, all combined tilt-and-turn windows are intended to fall within the scope of protection of the present application.

A window of the type described hereinabove is known from German Patents 3420883 C2 and 3432021 C2, for example. The two already known window constructions are designed as double windows. Therein there is disposed, in front of the actual window, which is provided with a window frame and a sash frame mounted pivotally therein, a further fixed glazing. Between the fixed glazing and the window bay there are disposed connecting cross sections to the intermediate space between the two glazings and the window bay, so that, in the case in which the sash frame of the inner glazing is opened, a certain air circulation can take place through the double glazing.

The object of the double glazing is to attenuate the effect of a detonation on the outside of the building to the extent that the persons present in the building suffer no injury if at all possible. Because of the openings between the edge of the outer glazing and the window bay, pressure equalization takes place in the event of an explosion shock, and so the pressure developed during the explosion may indeed be capable of destroying the outer glazing, but thereby the pressure spike is dissipated, with the result that the maximum pressure cannot act on the inner glazing, since the openings make it impossible for compression of the air inside the space between the two glazings to reach a hazardous level. Thus it is possible to provide the inner glazing with a swivelable or pivotally movable sash frame inside the window frame, so that the openings provided specifically for pressure relief between the outer glazing and the window bay can be used for ventilating the room.

The already known window construction can be regarded as suffering from disadvantages, in the first place because the manufacturing costs for the two glazings are comparatively high. In the second place, the outer glazing, which is usually destroyed in the event of a detonation, then represents a not inconsiderable danger for the persons present in the building, if the sash frame of the inner glazing is in its opened position. In this particular case, glass splinters can fly through the opened sash frame into the room interior, thus causing a not inconsiderable risk of injury. Moreover, the danger exists that, if the sash frame is wide open, the pressure rise in the interior of the building after the outer glazing has burst is still so great that persons suffer injury as a result. In principle, therefore, an adequate level of safety for persons present in the room is assured only if the sash frame of the inner glazing is in its closed position.

SUMMARY OF THE INVENTION

The object of the invention is to provide a window of explosion-resisting design, in which no outer front glazing is required and which nevertheless—while guaranteeing adequate safety against explosion shocks—can fulfill the function of continuous ventilation if necessary in open position of the sash frame.

According to the invention, the panel is made of armored glass and the window is provided with at least one tilt-limiting element, by means of which explosion induced tilting of the sash frame in the hinges beyond a tilt-limit position can be resisted. There is at least one shift-limiting element, by means of which explosion-induced shifting of the sash frame perpendicular to a tilt axis in the hinges can be resisted.

The invention is based on the knowledge that, contrary to prevailing doctrine as well as contrary to actual practice based on decades of experience, a tilted window, compared with a rigidly closed window, in no way fundamentally represents an incalculable safety risk in the event of an explosion. In fact, the known standard windows have substantially two weak points in regard to being explosion-resisting: Firstly, a (non-armored) panel cannot withstand the large-area pressure load and, because of the formation of splinters and propagation thereof into the room by the pressure wave, it endangers the persons present therein.

Secondly, the sash frame as a whole can be torn out of the window frame, since the fastening elements on a standard window—hinges and safety scissors mechanisms located opposite them—are not designed for a load that substantially exceeds either the dead weight of the sash frame with panel or the normal wind load. If the fastening elements break simultaneously due to the explosion, then the sash frame will be horizontally propelled in substantially unchanged orientation into the adjoining room. If the sash frame is torn from the hinges distinctly before or after being torn from the safety scissors mechanism, a rotational motion will be additionally imparted to the sash frame.

By limiting both tilting and shifting of the sash frame from the window frame as well as by using an armored panel, the inventive window not only resists an explosion in the same way as does the known double window, but also the risks associated with an inner standard window are effectively prevented.

The special advantage of the inventive window lies in the fact that, despite its safety against an explosion, it can be moved into a tilted position for ventilation, whereas in the case of known windows any open position of the window would mean an incalculable risk. The inventive tilt-limiting element is not to be thought of as a standard opening-limiting rail, which is used in conventional non-safety windows and which would not withstand the forces occurring during detonation of explosives. Likewise, a shift-limiting element is not to be understood as a standard, peg-type interlocking element, as is coupled with the pushrod of the fittings in conventional non-safety windows and engages in interlocking pockets immobilized in the window frame.

Preferably the hinges of the window are strengthened and thereby designed as shift-limiting elements. The use of strengthened hinges compared with a standard window prevents the sash frame from being torn out of the window frame up to a selectable level. Strengthening can be achieved by using a material of higher grade than the usual tool steel, such as a high-tensile steel. Alternatively, the number of hinges disposed along the tilt axis can be increased.

In a preferred embodiment, the window is provided with at least one shift-limiting element, which is disposed on a side of the sash frame located opposite the hinges, and by means of which explosion-induced shifting of the sash frame from the tilt-limit position and from any position between this and the closed position into a plane of the panel perpendicular to the tilt axis can be resisted by the fact that the sash frame is stopped against a stop, formed in the shape of a circular segment on the shift-limiting element. In the first place, such an additional shift-limiting element does not necessitate any modification of the hinges, and so it is suitable for use in particular with standard frames. In the second place, use together with hinges strengthened in the manner described in the foregoing is also conceivable.

Also advantageous is the use of at least one two-piece shift-limiting element, which is disposed in the tilt axis and which is provided with a female coupling connected to the window frame and with a male coupling connected to the sash frame, the female coupling and the male coupling being provided with hook-like interlocking elements, wherein shifting in tilt-limit position and in any position between this and closed position can be resisted by the fact that the interlocking elements formed on the female coupling and male coupling engage in one another. The use of such shift-limiting elements and the geometry thereof is known in principle in break-in-proof windows. To achieve an explosion-resisting capability by comparison, these can in turn be strengthened, as described in the foregoing for the hinges.

Such a shift-limiting element in turn permits firstly the use of sash frames and window frames of a standard window, provided the female and male couplings are dimensioned such that they can be disposed in an existing gap between the sash frame and window frame. By combination with the shift-limiting elements described in the foregoing, the effect of the individual elements can be enhanced to correspond to the particular application and the explosive force to be safeguarded against.

Preferably the male coupling of such a shift element is connected to a pushrod attached to the sash frame of an inventive window and can be shifted therewith along the tilt axis to the extent that the interlocking elements no longer engage in one another. The use of pushrods is known in principle for standard windows, which besides the tilt function also permit swiveling of the sash frame around an axis perpendicular to the tilt axis. Thus an inventive window can also be designed as a combined turn-and-tilt window.

An inventive window is advantageously provided with safety scissors mechanisms that have been strengthened and thereby are designed as tilt-limiting elements, which scissors mechanisms are mounted on the one hand in the window frame and on the other hand in the sash frame. The design options for strengthening and the advantages resulting therefrom have already been described in the foregoing with regard to strengthening of hinges, and are equally valid for the safety scissors mechanisms.

In an inventive window, there is preferably disposed at least one tilt-limiting element on the side of the sash frame located opposite the hinges, against which element the sash frame is stopped in tilt-limit position. Such an additional shift-limiting element in the first place does not require any modification of the hinges, and so it is suitable for use in particular with standard frames. In particular, such a tilt-limiting element can be combined advantageously with a stop formed in the shape of a circular segment in the manner described in the foregoing, in such a way that the end of a stop rail having the shape of a circular segment forms the tilt-limiting element at its end.

In a particularly advantageous embodiment, such a tilt-limiting element is disposed at each of the two ends of the side of the sash frame located opposite the hinges. Compared with a rod-shaped design substantially over the entire length of the side of the sash frame located opposite the hinges, the bracing effect of the sash frame itself is utilized by the structure comprising two individual tilt-limiting elements at the corners. This effect can be further improved by a reinforcing liner or a differently reinforced design of this side of the sash frame. By the use of separate tilt-limiting elements, these can virtually be used as elements of construction kits for inventive windows of different widths.

Preferably a stop located opposite the hinges to act as a tilt-limiting element of an inventive window can be connected in such a way to a window bay in which the window can be inserted that the tilt-limiting element can be shifted between an operating position and a maintenance position, wherein the sash frame in maintenance position of the tilt-limiting element can be opened beyond the tilt-limit position. If the tilt-limiting element is in maintenance position, then the sash frame when opened does not become stopped against it. The sash frame can then be opened sufficiently wide for maintenance purposes that its outside—for example, for cleaning the outer face of the panel—is easily accessible from the room. The sash frame can then be designed such that it can be opened wide in the tilt axis or in an axis perpendicular thereto. The tilt-limiting element can be connected to the window bay indirectly, via the window frame (which is connected to the window bay), or directly.

Such a shiftable tilt-limiting element on an inventive window is preferably capable of being bolted detachably to the window bay. The detachable bolted connection represents the technically simplest and therefore least expensive option for designing a shiftable element. In an advantageous embodiment of an inventive window, such a tilt-limiting element is sufficiently shiftable in slots in a plane of the window frame that in its maintenance position it is spaced further apart from the hinges than in its operating position. In slots, it is possible on the one hand to guide the tilt-limiting element particularly simply in the manner of slideways, and on the other hand the retaining function in the slots is not substantially impaired.

Especially when, for safety reasons, for example, it is desired that an inventive window never be opened beyond a tilt-limit position—including for maintenance purposes—such a stop, against which the sash frame is stopped with its side located opposite the hinges, can also be immovably connected to the window frame or directly to the window bay. Such a design of an inventive window will then also be much less expensive to manufacture than the corresponding version with the adjustable tilt-limiting element described in the foregoing.

It is particularly preferred that the sash frame in tilt-limit position be braced by means of a retaining device both against continuation of the turning movement and against a movement directed away from the window and toward the plane of the panel, and that form-fitting closing elements be present between the sash frame and the window frame in the region of the frame leg connecting the pivotal joints of the sash frame, in this case the opening angle in tilt-limit position of the sash frame being between 5° and 50°.

The philosophy adopted for the inventive window is that a window of explosion-resisting design can be disposed in slightly open position of the sash frame without the need for front glazing even in the event of a detonation, provided the opening cross sections exposed hereby are sufficiently small and uncontrolled further opening of the sash frame beyond the tilt-limit position is prevented despite the occurring pressure wave. By tilt-limit position there is meant in the scope of this application that position defined by the retaining device in which the sash frame is deflected as far as possible from its closed position. Depending on the size of the room bounded by the window, the opening cross section exposed in tilt-limit position is preferably at most 0.2 $m^2$ to 0.4 $m^2$. In very spacious rooms, correspondingly larger opening cross sections can also be achieved, since a large room volume has a larger buffer effect and therefore attenuates the pressure rise in the room. With such cross-sectional areas, the pressure will be sufficiently attenuated by the relatively small cross-sectional area before it enters the room, even in the case of detonation of large quantities of explosive and a short distance between the detonation point and the inventive window, that harmful effects on persons present in the room can usually no longer occur. In the case of the inventive window, therefore, it is not necessary to keep the sash frame in closed position in order to achieve adequate safety, but instead the window can—if desired—be kept continuously in the tilt-limit position, whereby very thorough ventilation is possible.

In the case of a pressure load acting from outside on the opened sash frame, the said sash frame is pressed inward with great force against the retaining device. Under those circumstances, both further swiveling of the sash frame and also movement thereof in radial direction away from the pivotal joints is prevented by the inventive design of the retaining device. The form-fitting closing elements in the region of the frame leg connecting the pivotal joints of the sash frame ensure that tearing of the sash frame away from the window frame in this region is prevented, as is therefore a turning movement around the stop face of the retaining device. The sash frame is therefore securely fixed in the tilt-limit position despite the detonation-induced pressure effect, and so the pressure rise in the room located behind the window is controlled and attenuated by the relatively small size of the opening cross section. Because front glazing is not required, the costs for the inventive window are comparatively low, and the visual appearance on the outside of the building is not impaired and does not differ from the case of conventional windows.

Preferably the retaining device has a continuous support surface, which extends from the window frame to a stop face, against which the sash frame bears in tilt-limit position, wherein the support face runs parallel to the trajectory that the front edge of the sash frame describes during displacement from closed position into tilt-limit position. Hereby tearing of the sash frame out of the pivotal joints is prevented even if the sash frame is in arbitrary intermediate positions between the closed position and the tilt-limit position.

In a further configuration of the invention, it is provided that the retaining device is composed of a lower strap provided with the support face and of an upper strap running perpendicular to the plane of the panel, the lower strap and upper strap being connected to one another both in the region of the window frame and also of the stop face. Hereby there can be achieved a construction that is easy to make, is visually appealing and is very torsionally stiff. If an anchor connecting the window frame with a part of the building structure is driven through an anchoring portion of the retaining device, the loadability of the retaining device is particularly large, since transmission of force into the window frame itself via special connecting elements between the retaining device and window frame is not necessary, but instead direct force transmission into the load-bearing part of the building structure is possible. Particularly good bracing of the entire window construction within the opening of the building structure is achieved by the fact that the anchor for fastening the window frame is connected to an angle piece of L-shaped cross section, which with one leg extends parallel to a window bay and with the other leg extends parallel to a visible face of the building. Hereby a boundary strip of the visible face adjoining the opening can be used for transmission of compressive forces into the part of the building structure over a large area, thus minimizing the danger that the strength limits will be exceeded locally.

In order to reduce the ventilation cross section exposed in tilt-limit position and thus to attenuate the pressure rise in the room in the event of a detonation in the case of very large windows or very large opening angles, at least part of the opening cross section exposed by the sash frame in its tilt-limit position can be covered by a perforated plate, which is connected, for example, to the retaining device or directly to a part of the building structure.

In an advantageous fastening of the perforated plate, the said plate is provided with two bent-over edge strips on the narrow side and one edge strip on the long side, the latter covering a connecting strut that connects the upper strap to the lower strap. In this way there is obtained a rudimentary box-like structural member, which is distinguished by its very high stiffness.

In order to attenuate force spikes during transmission into the retaining device in the event of an explosion, the stop faces for the sash frame should be made of an elastomeric material.

In a further improvement of the invention, the form-fitting closing elements are formed by two angle profiles, each of which is connected by a fastening leg to the sash frame and to the window frame, preferably extends over the entire length of the associated frame leg and is braced against the other by a support leg.

If the support legs bear against one another in tilt-limit position and thus are oriented parallel to one another, the pressure per unit area acting on the angle profiles is minimized and the risk of deformation is particularly low.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views

FIG. 1' shows an outside view of the window;

FIG. 3' shows a horizontal section along line III-III through the window according to FIG. 1', and FIG. 4' shows an inside view of the window according to FIG. 1'.

DETAILED DESCRIPTION OF THE PREFERRED EMBODIMENT

Figure 1:
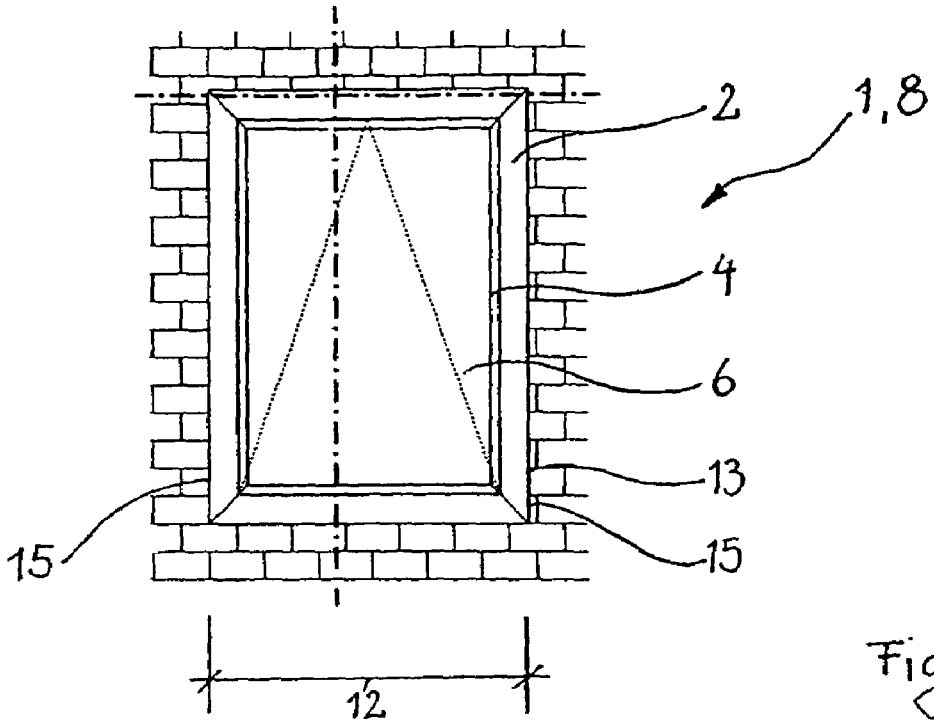
FIG. 1 shows an outside view of a first embodiment of the window of the invention.
Figure 2:
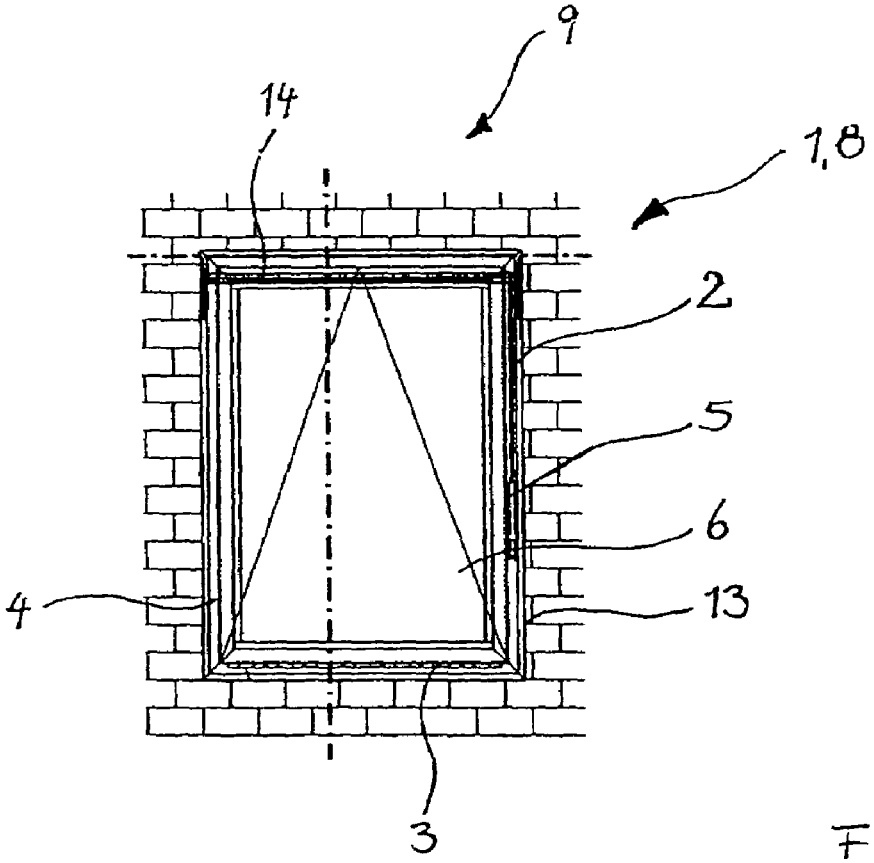
FIG. 2 shows an inside view of the window of FIG. 1.

Referring now in detail to the drawings, the first window 1 illustrated in FIGS. 1 to 4 is provided with a window frame 2, on which a sash frame 4 is mounted tiltably by means of a tilting-sash actuating element 5 in a plurality of hinges 3 (in the manner of a "piano hinge", although usually comprising individual hinges). By hinge within the meaning of this application, there is to be understood any structural member that permits an articulated connection of the sash frame to a window frame and thus permits a turning, tilting or swiveling movement of the sash frame around at least one axis of rotation. A panel 6 of armored glass is accommodated in sash frame 4. Hinges 3 of window 1 are strengthened compared with a commercial standard tilting window by the use of hinge pins, hardened steel or stainless steel, and so are designed as shift-limiting elements 7. Hereby tearing of sash frame 4 out of hinges 3 and out of window frame 2 by the effect of an explosion is effectively prevented. FIGS. 1 and 2 show window 1 in closed position 8, in which sash frame 4 is nested in window frame 2.

Figures 1, 2A, 3, 4:
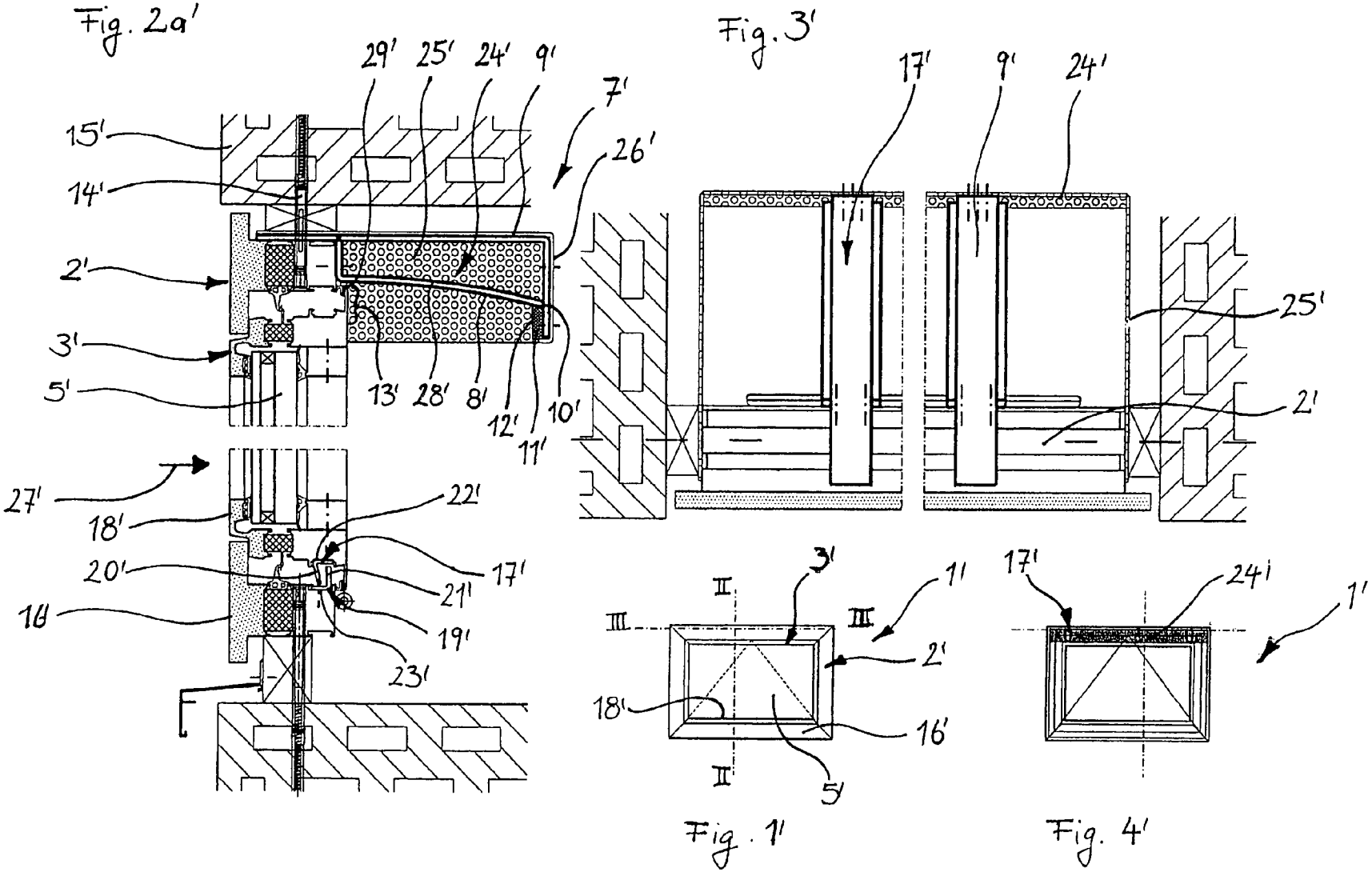
FIG. 3 shows a vertical section therethrough.
FIG. 4 shows a horizontal section through this first window, in each case in tilted condition.
FIG. 2*a'* shows a vertical section along line II-II through the window according to FIG. 1' in closed position.

On side 9 of sash frame 4 located opposite hinges 3 there is disposed on window frame 2 a tilt-limiting element 10 against which sash frame 4 is stopped in tilt-limit position 11, as illustrated in FIGS. 3 and 4. This condition of being stopped against tilt-limiting element 10 effectively prevents sudden further tilting—in a manner potentially dangerous to persons present in the room—of sash frame 4 beyond tilt-limit position 11.

Tilt-limiting element 10 is provided with a continuous rod 14 over the entire width 12 of window bay 13, in which window 1 is inserted, and is bolted to both sides 15 of window bay 13 in slots 16. After each of two wing nuts 17 has been loosened, tilt-limiting element 10 can be manually shifted to a larger distance from hinges 3 by means of a connecting rod (not illustrated) between operating position 18 (illustrated in bold) and maintenance position 19 (indicated by dashes). Alternatively, inventive window 1 can also be equipped with a crank mechanism (not illustrated), by means of which tilt-limiting element 10 can be transferred from operating position 18 into maintenance position 19. Tilt-limiting element 10 can be immobilized in maintenance position 19, in a manner that also is not illustrated, and sash frame 4 can be tilted beyond tilt-limit position 11 for maintenance purposes—in particular at regular intervals for cleaning purposes.

Second window 20 illustrated in FIGS. 5 to 9 differs from first window 1 according to FIGS. 1 to 4 in the first place by the fact that it is designed as a combined turn-and-tilt window and thus can be tilted around a tilt axis that is horizontal in installed condition or alternatively can be swiveled around a vertically oriented swivel axis. Window 20 is provided with the fittings—hinges and safety scissors mechanisms—known for standard windows. (The tilt and swivel axis as well as the tilt hinges and safety scissors mechanisms are not illustrated.)

Window 20 is provided in the tilt axis with a plurality of first shift-limiting elements 23, each of two-piece design, distributed over width 21 of sash frame 22. First shift-limiting elements 23 are each composed of a female coupling 25 connected to window frame 24 and of a male coupling 26, which is attached to the pushrod (not illustrated) and which can be shifted together therewith along the tilt axis. Female couplings 25 and male couplings 26 are provided along the tilt axis with a constant profile and engage in one another with hook-like interlocking elements 27. By means of first shift-limiting elements 23, window frame 24 and sash frame 22 are coupled firmly with one another in tilt-limit position 28 according to FIG. 7 and in every intermediate position (not illustrated) between this and the closed condition according to FIGS. 5, 6 and 8.

At each of the ends of side 29 located opposite the hinges there is attached a stop 30, which together with a crossbar 31 attached to sash frame 22 acts on the one hand as a second shift-limiting element 32 and on the other hand as a tilt-limiting element 33. Stop 30 is made from flat steel and is bolted to window frame 24 or to a building part disposed next to it. In this way, stop 30 is also connected at least indirectly to window bay 34, in which window 20 is inserted. Each stop 30 is provided with a through-hole 35 having the shape of a circular segment (or alternatively also with a guide rail having the shape of a circular segment), in which the respective associated crossbar 31 engages. The center of the circle (not illustrated) associated with the circular segment lies on the tilt axis. The two crossbars 31 are made of round steel and extend parallel to the tilt axis in sash frame 22. By actuating a lever 36 attached to sash frame 22, crossbars 31 can be shifted parallel to the tilt axis in the manner of a driving crossbar. The function of lever 36 can also be ensured by a mechanism (not illustrated), which depending on the case can also be electrically powered, covered or separately lockable.

Figure 8:
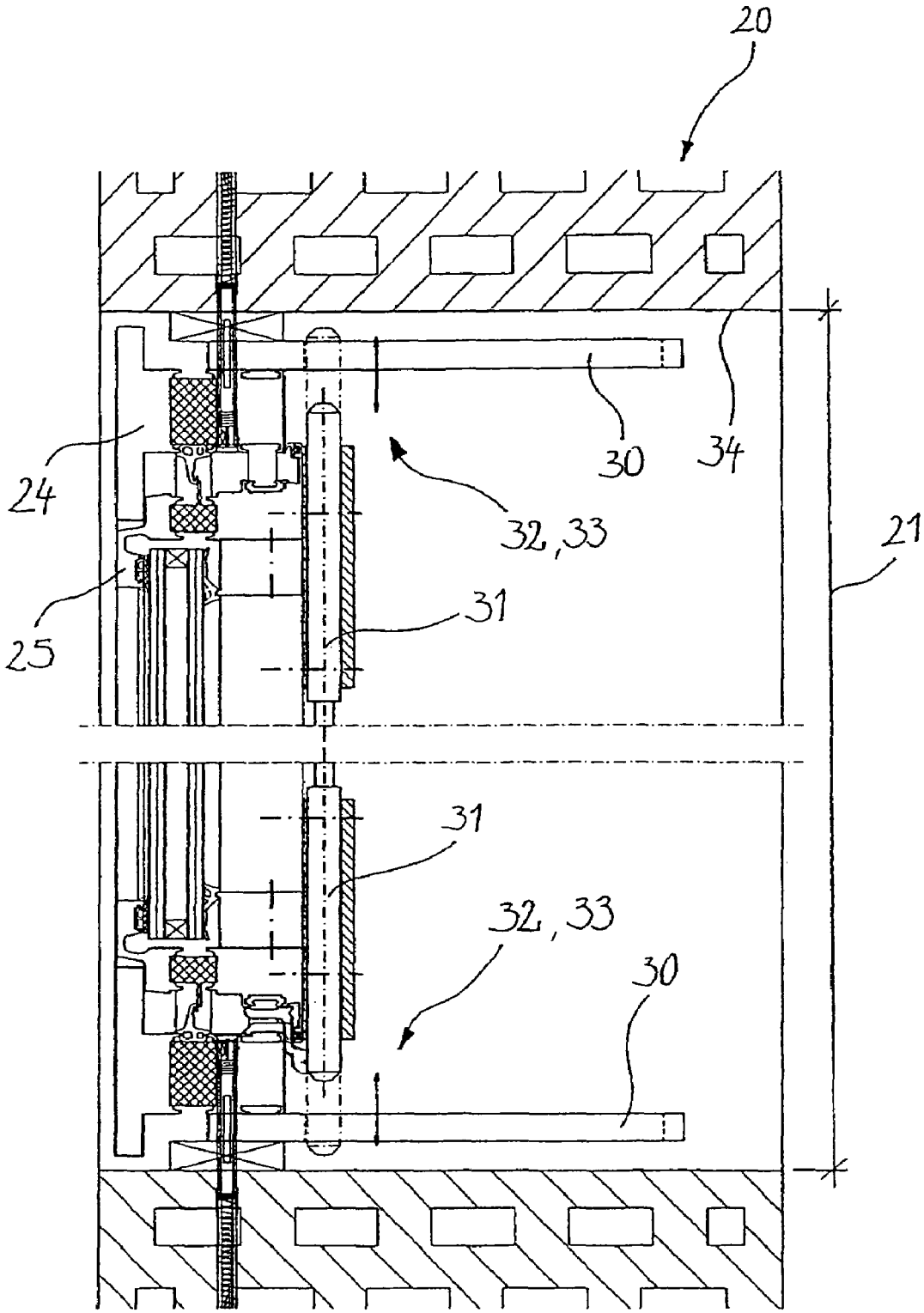
FIG. 8 shows a horizontal section in closed condition.
Figure 9:
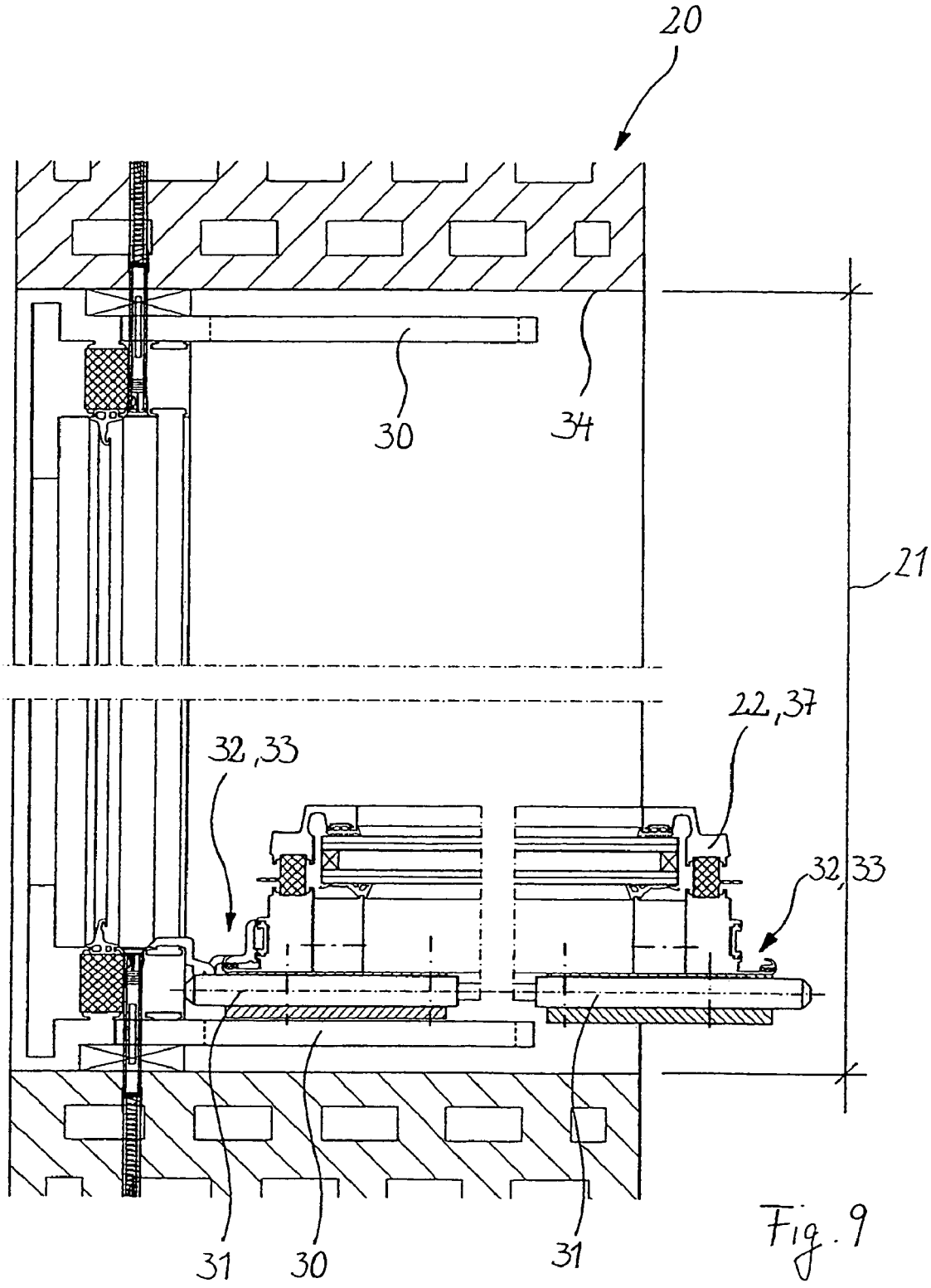
FIG. 9 shows a horizontal section in maintenance position through this second window.
Figure 10:
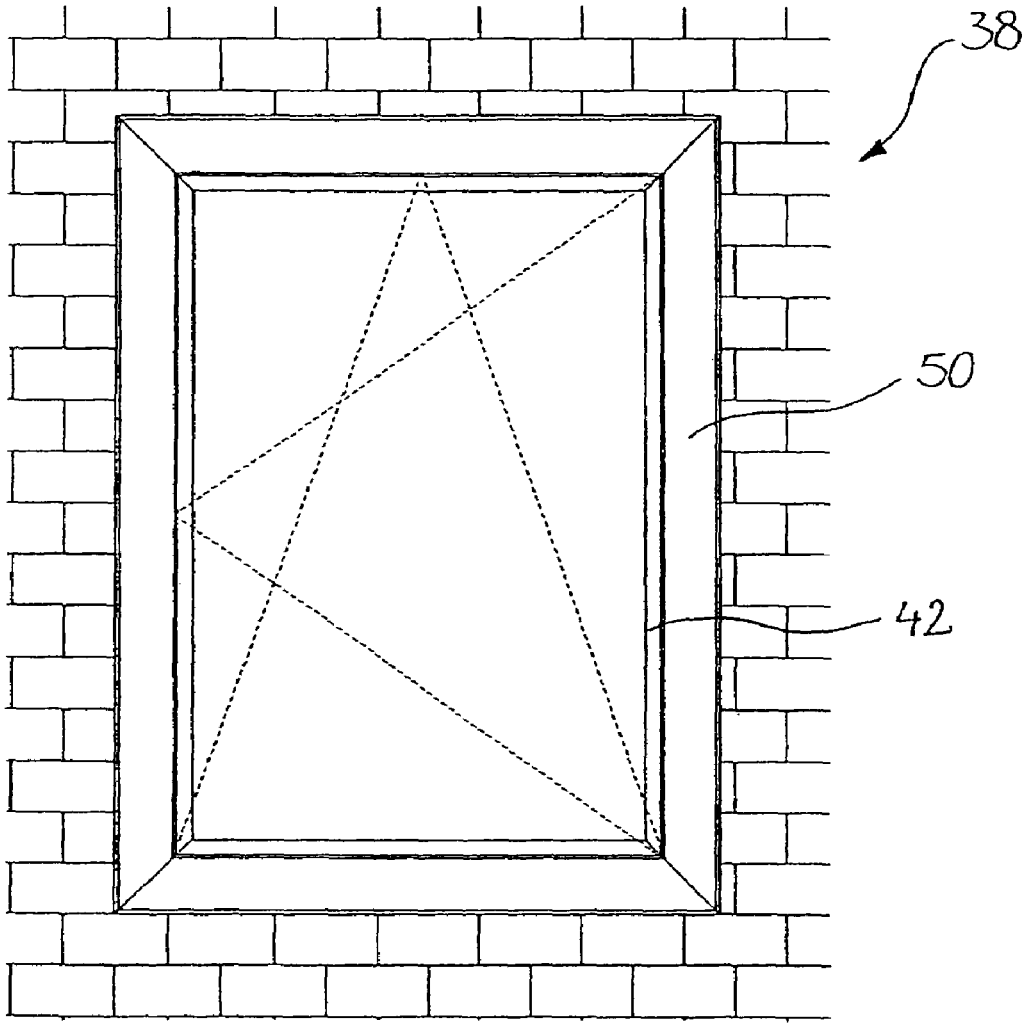
FIG. 10 shows an outside view of a third embodiment.
Figure 11:
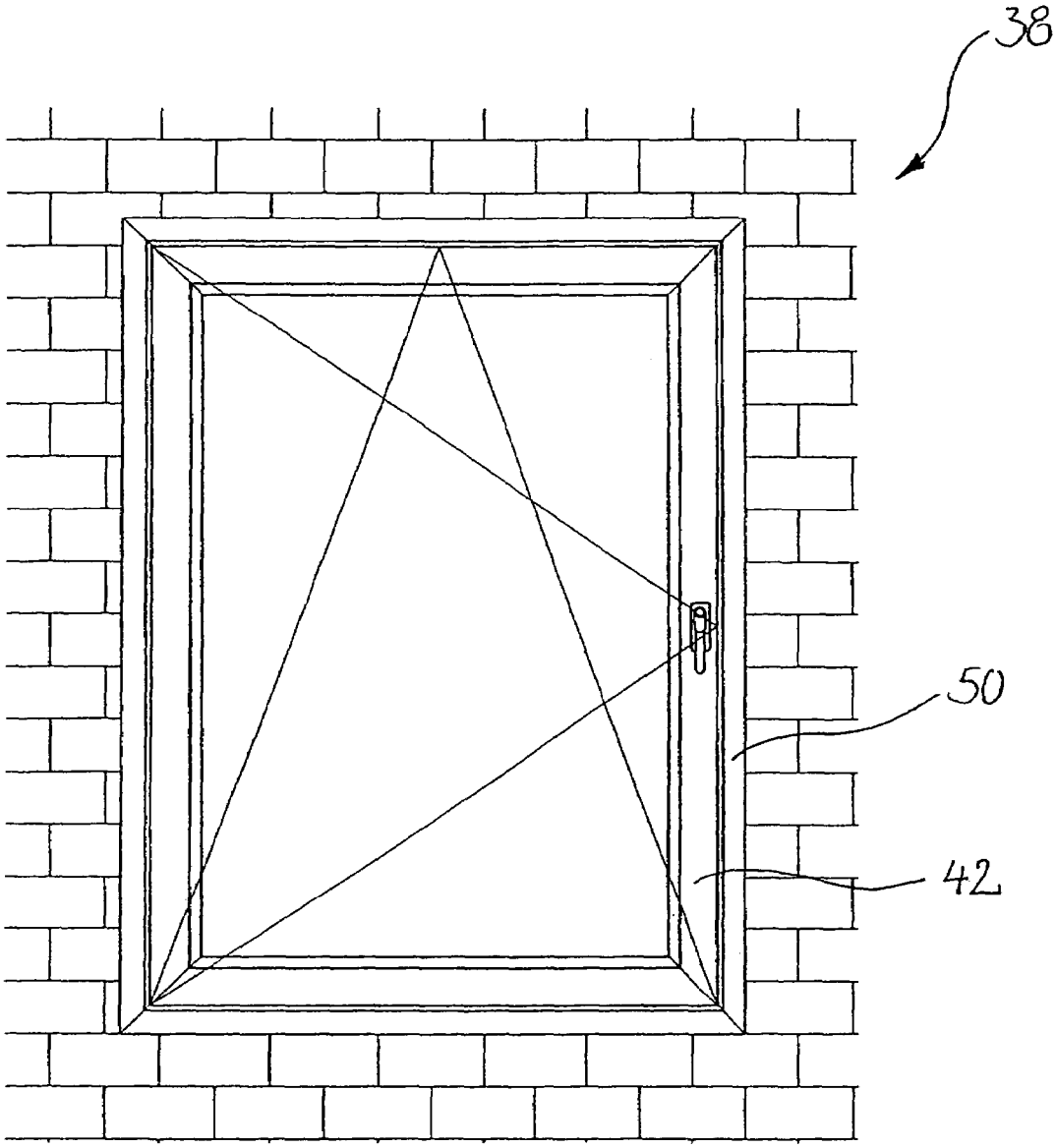
FIG. 11 shows an inside view thereof.
Figure 12:
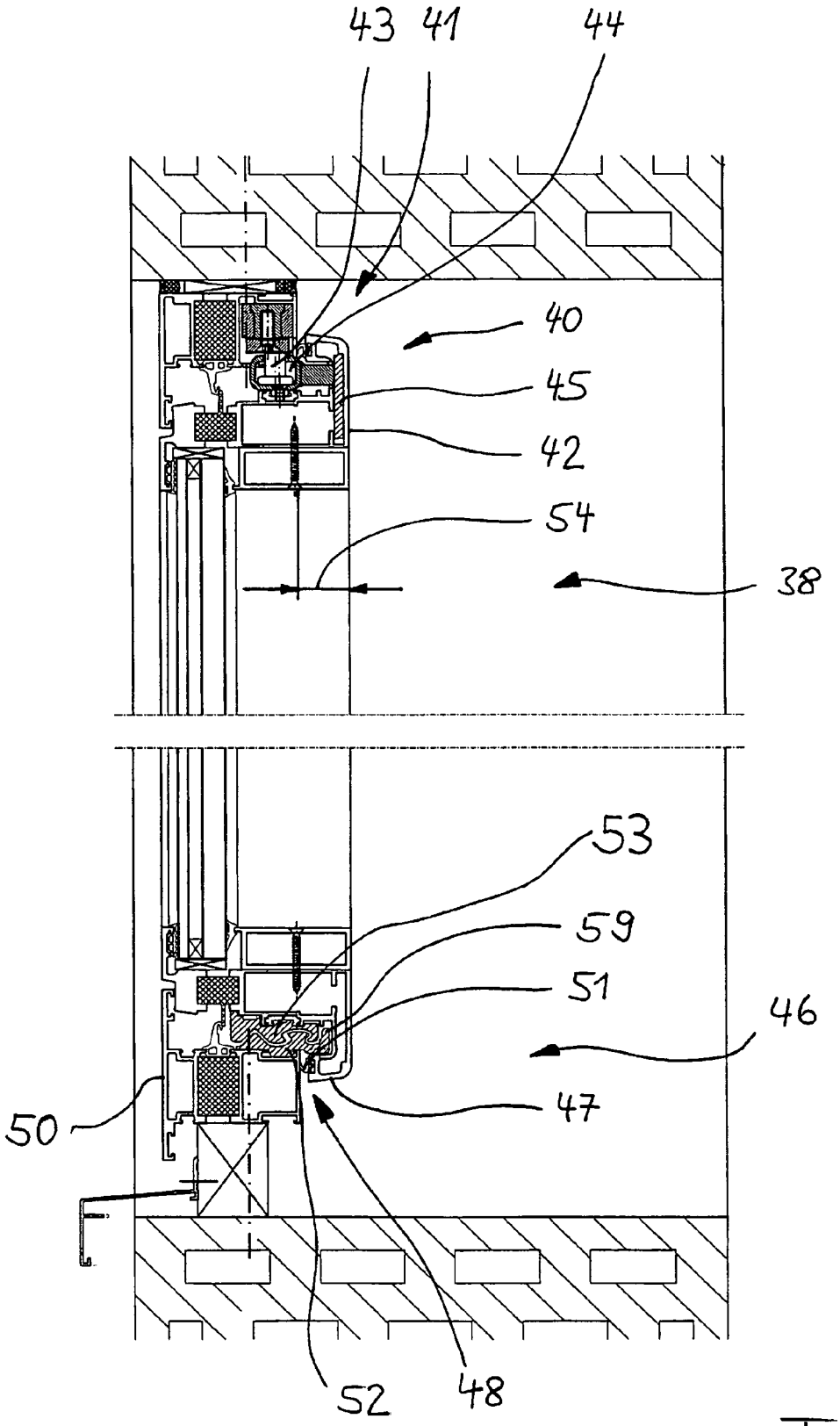
FIG. 12 shows a vertical section in closed condition.
Figure 13:
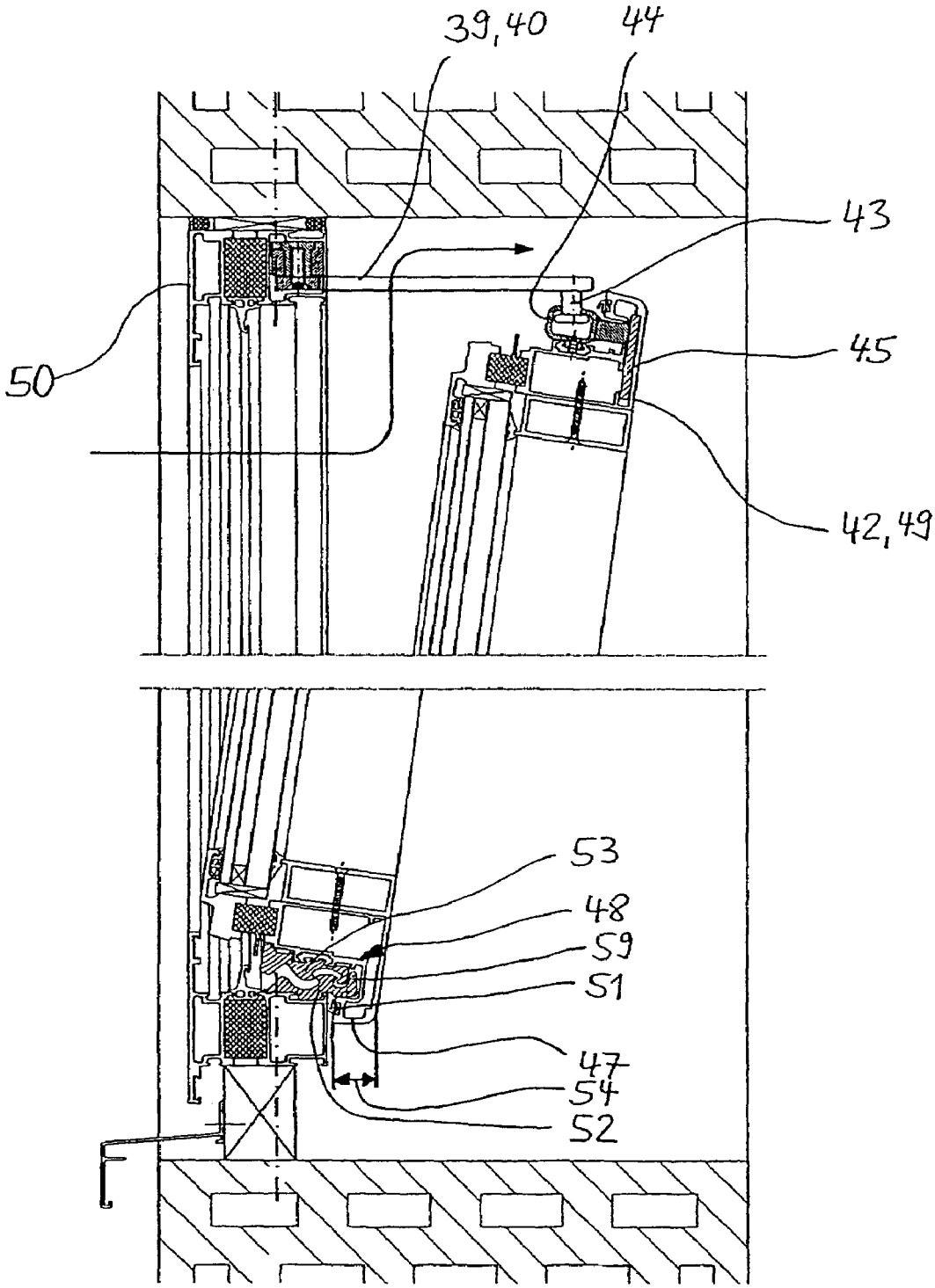
FIG. 13 shows a vertical section in tilted condition.

In order to be able to swivel sash frame 22 around the vertical swivel axis into maintenance position 37 according to FIG. 9, male couplings 26 of first shift-limiting elements 23 are disengaged in a manner not illustrated from female couplings 25, and crossbars 31 of second shift-limiting elements 32 are disengaged from through-hole 35 in accordance with the illustration (in bold) in FIG. 8.

In contrast to second window 20 according to FIGS. 5 to 9, third window 38 illustrated in FIGS. 10 to 13 is not provided at its upper side with a stop-containing guide having the shape of a circular segment. The function of tilt-limiting element 39 is performed here by a safety scissors mechanism 40 on upper side 41 of sash frame 42. This safety scissors mechanism, which is known in principle, is again strengthened compared with the turn-and-tilt fitting of a standard window and is made, for example, from stainless steel. In addition to the at least one aforesaid safety scissors mechanism 40, window 38 can also be provided with a standard tilt-limiting scissors mechanism, as is present in standard fittings, although it does not perform any safety function but is present merely by virtue of the use of standard fittings.

Safety scissors mechanism 40 is provided with a mushroom-shaped peg 43, which engages in a channel-shaped hollow profile 44 disposed parallel to the tilt axis, which again is not illustrated. Hollow profile 44 is welded together with a steel panel 45 fitted into sash frame 42 and is bolted to a pushrod. Together therewith, hollow profile 44 can be shifted parallel to the tilt axis in sash frame 42. Thus, as is known from standard windows, the swiveling movement of sash frame 42 around the vertical axis of rotation is not restricted.

In the installed condition, sash frame 42 engages, by means of a nose 47 formed on its underside 46, with shift-limiting element 48 from below, and in tilt-limit position 49 is stopped against window frame 50. In this way, upward shifting of sash frame 42 is effectively prevented. Between nose 47 and window frame 50 there is disposed a sealing element 51, by means of which an air stream through the fit (which by its nature has some clearance) between female coupling 52 and male coupling 53 is suppressed. Window 38 is provided with a stop depth 54 that is much larger than that of a standard window, to ensure that interlocking can be transferred from closed position to tilted position, that adequate installation depth is available for the structure of encircling nose 47 and that great stability and high safety against tearing-out of the mounting of the scissors mechanism is provided via steel panel 45.

Figure 14:
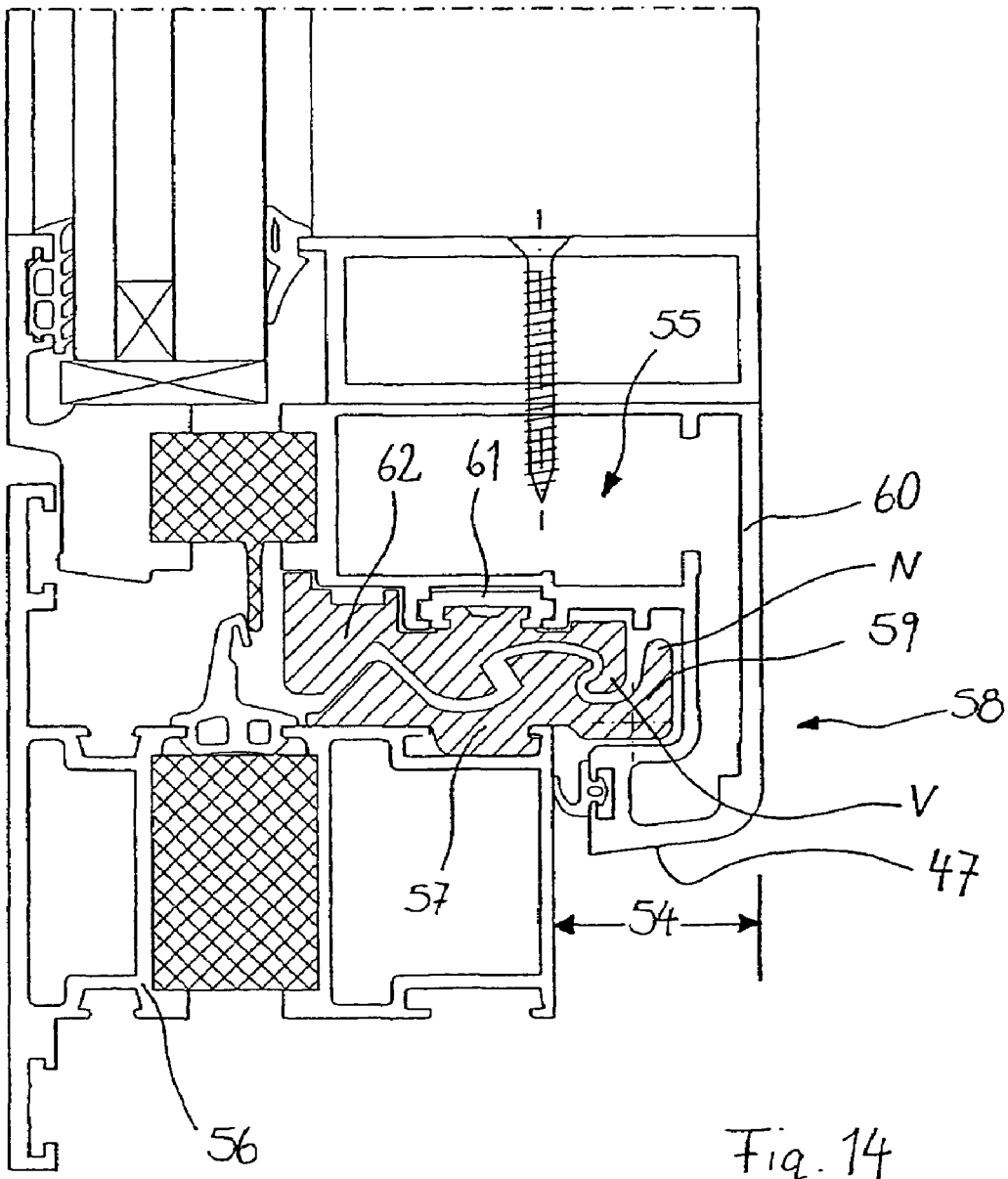
FIG. 14 shows a detail of a fourth window in closed condition.
Figure 15:
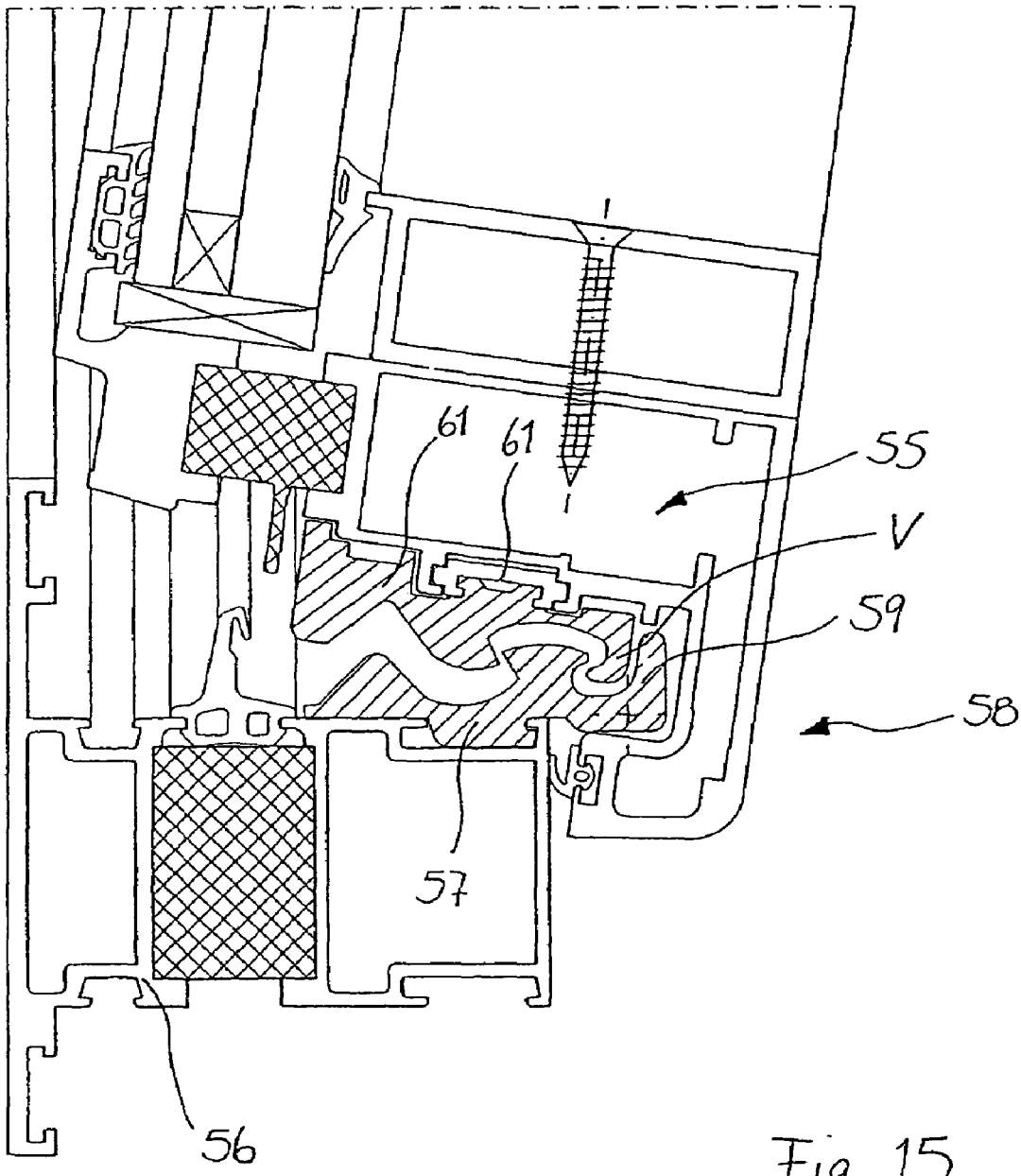
FIG. 15 shows the same in tilted condition, in each case in vertical section.

In contrast to the aforesaid third window 38 according to FIGS. 10 to 13, the fourth window illustrated merely in detail in FIGS. 14 and 15 is provided with an alternatively designed shift-limiting element 55, whose female coupling 57 connected to window frame 56 is provided on side 58, which in installed condition faces the room interior, with an upwardly projecting nose 59. In the installed condition, and especially also in the tilted position illustrated in FIG. 15, sash frame 60 therefore cannot be forced into the room. Clearly recognizable in FIGS. 14 and 15 is pushrod 61, which can be moved axially in sash frame 60, and with which male coupling 62 is connected, whereas female coupling 57 is connected firmly to window frame 56.

Also in tilt-limit position female, couplings 57/male couplings 62 safely prevent, by virtue of nose 59 on the female coupling and nose 47 on sash frame 60, both displacement of sash frame 60 perpendicular to the plane of the panel into the room and also parallel to panel 6 perpendicular to the tilt axis.

Besides pairs 57/62 of female coupling and male coupling, which pairs are effective in tilted position of sash frame 60, there can be provided further similar pairs, which are in engagement in closed position of sash frame 60 and in this position are effective as shift-limiting elements. However, the same pairs can also be effective in tilted and closed positions of sash frame 60.

A window 1' illustrated without the surrounding building parts in FIG. 1' has a window frame 2', in which a sash frame 3' is mounted movably. Sash frame 3', which is provided with a panel 5' in the form of an insulating-glass pane, is a tiltable skylight. Safety against detonations is imparted to the tilting sash by the fact that it is fixed in its tilt-limit position (FIG. 2*b'*) by a retaining device 7', and thereby exposes only an accurately defined, comparatively small opening cross section between the room and the surroundings, whereby uncontrolled propagation of pressure from outside into the room is prevented.

As is evident from FIG. 2*a'*, retaining device 7' is composed of a bow-shaped lower strap 8', which is bent over in L-shaped fashion, and of an upper strap 9', which is also L-shaped and whose vertically oriented leg functions as a connecting strut 10', at the lower end of which there is disposed an elastomeric element 11', which forms a stop face 12' for an upper edge strip 13' of sash frame 3'. Lower strap 8' and upper strap 9' are connected to one another by welding, with the result that there is obtained a stiffly connected retaining device 7' having the general shape of a stirrup. Through this there is driven, in the region of an end portion of upper strap 9', an anchor 14', which connects window frame 2' to a part of the building structure in the form, for example, of a perforated brick 15'.

From FIGS. 2*a'* and 2*b'* it is evident that lower strap 8' forms, with its lower side facing the upper side of sash frame 3', a support face 28' extending from sash frame 2' to stop face 12'. This support face 28' runs at a short distance parallel to the trajectory—in the form of a circular segment—that front edge 29' of the sash frame describes during displacement from closed position to tilt-limit position. Hereby there is achieved, in every position of sash frame 3', very high safety against movement thereof in radially outward direction, as could otherwise occur after the hinge strips have been torn off.

Figure 2B:
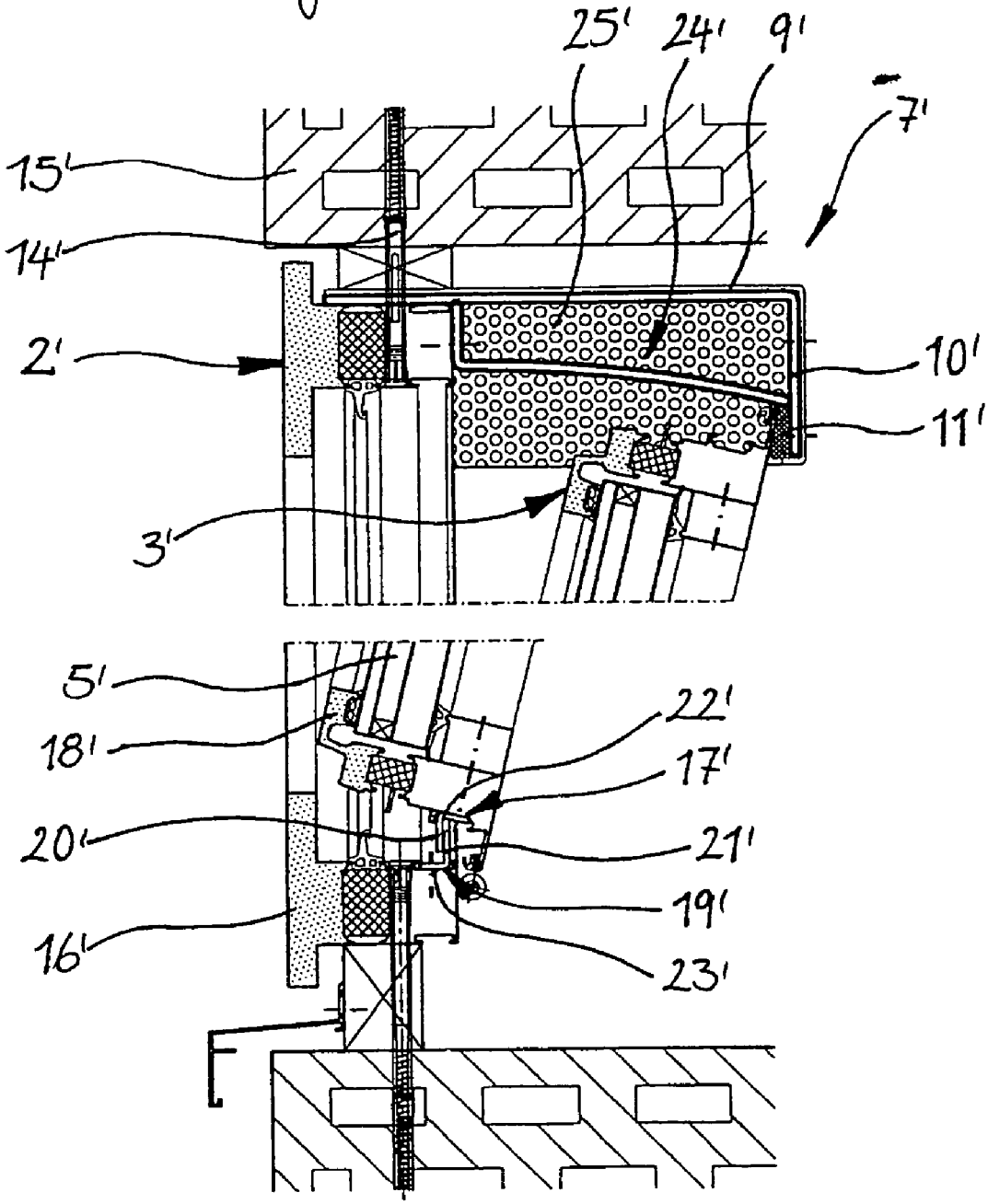
FIG. 2*b'* shows the same as FIG. 2*a'*, but in tilt-limit position.
Figure 3:
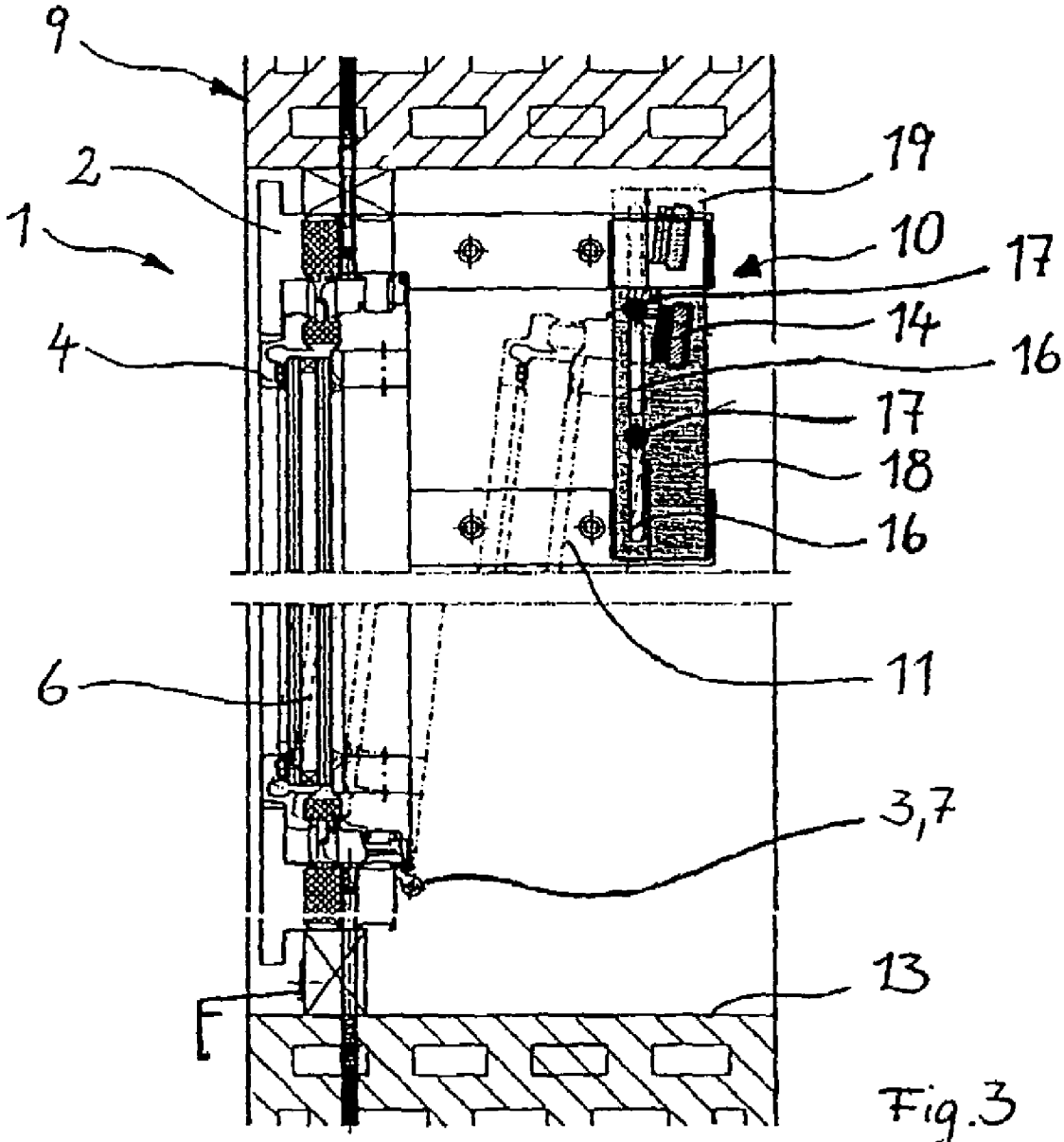
Figure 4:
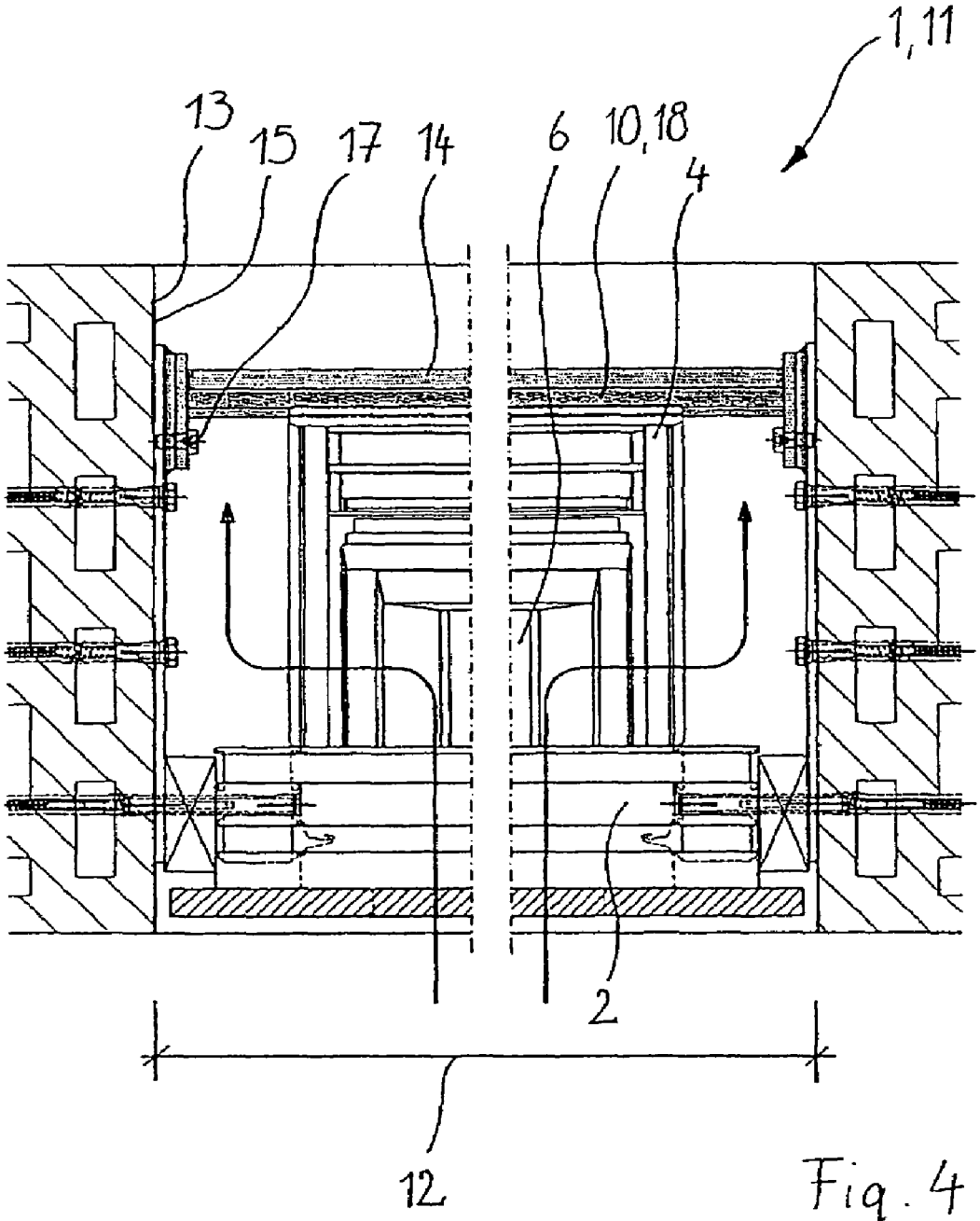
Figure 5:
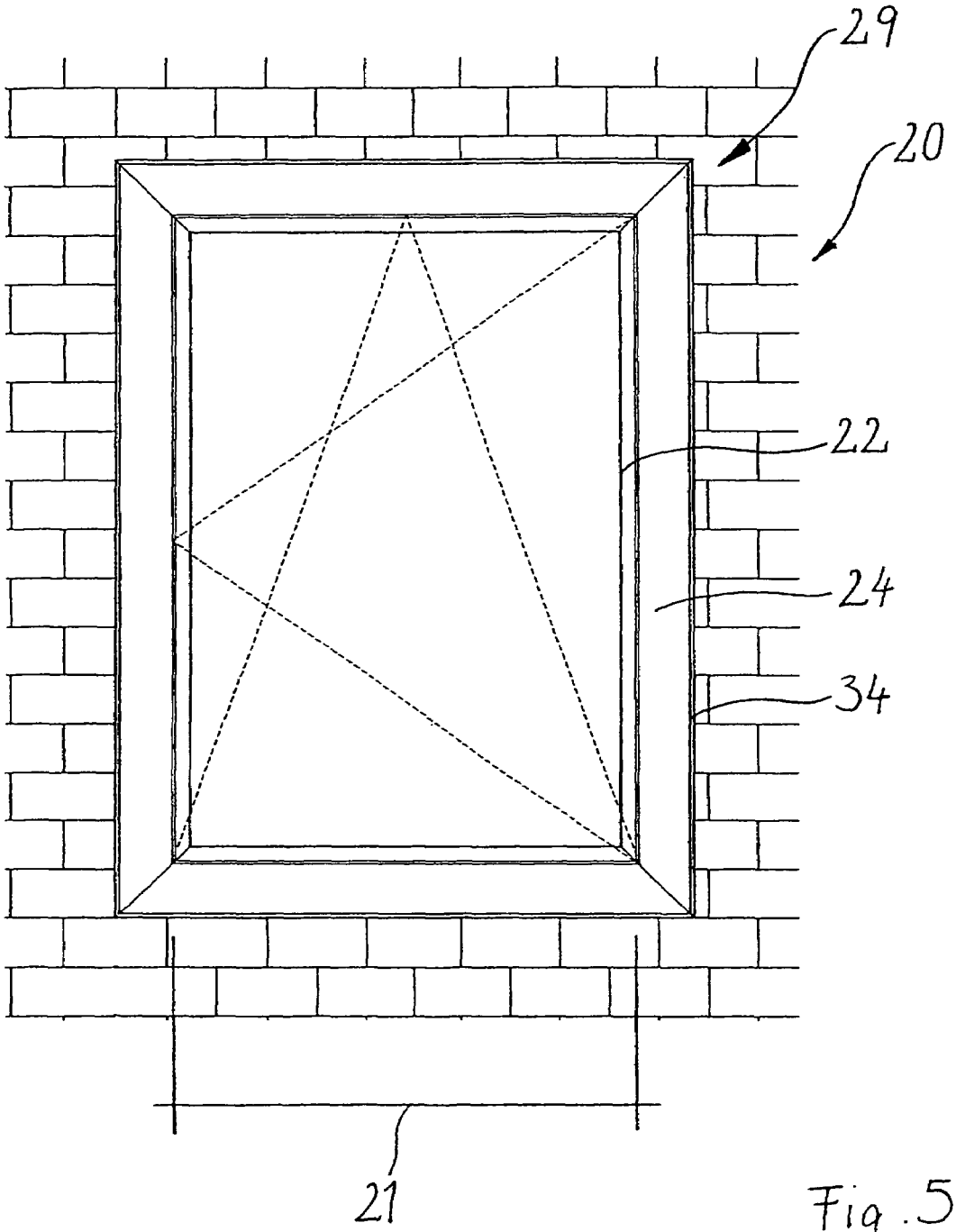
FIG. 5 shows an outside view of a second embodiment.
Figure 6:
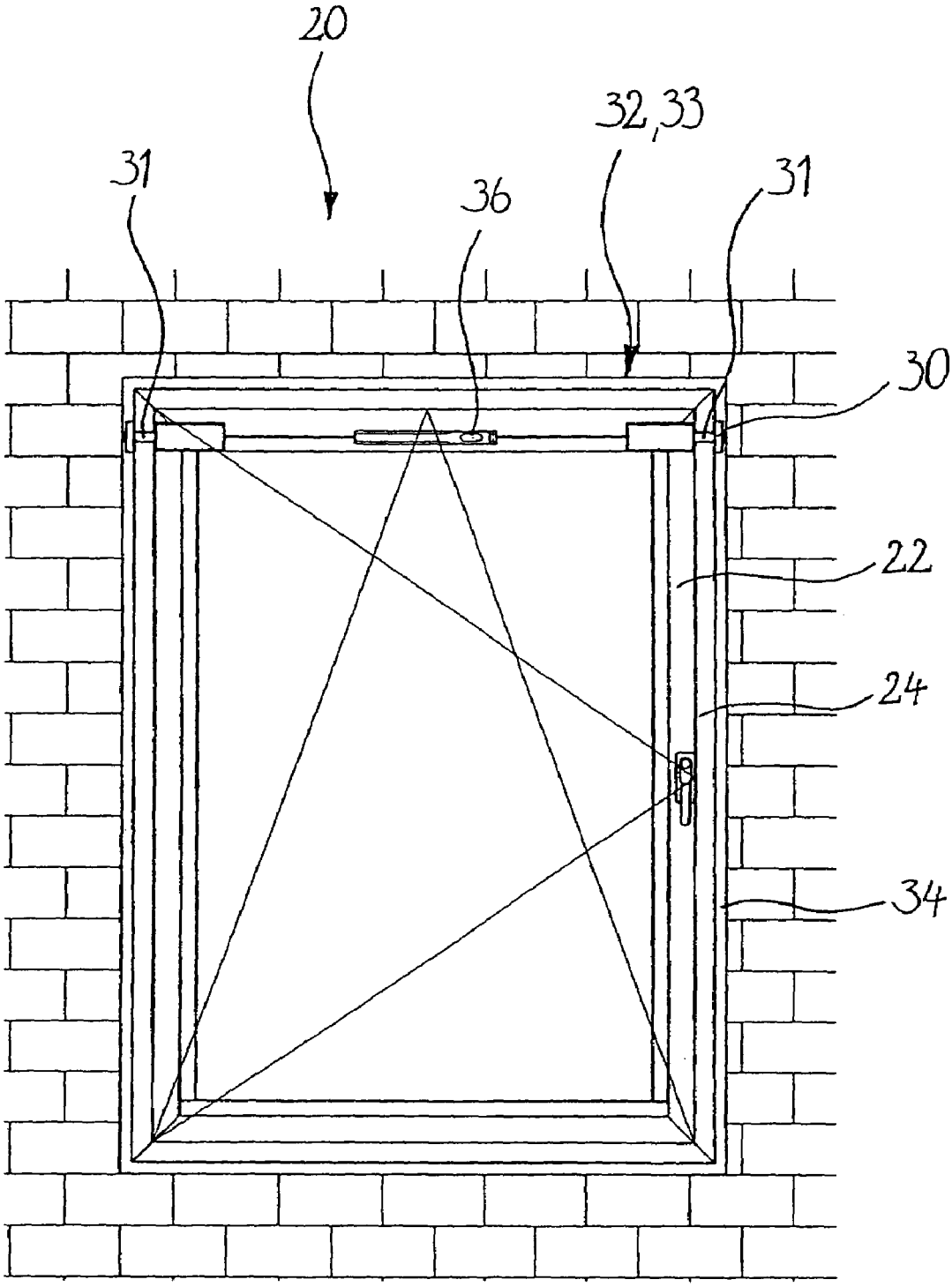
FIG. 6 an inside view of the embodiment of FIG. 5.
Figure 7:
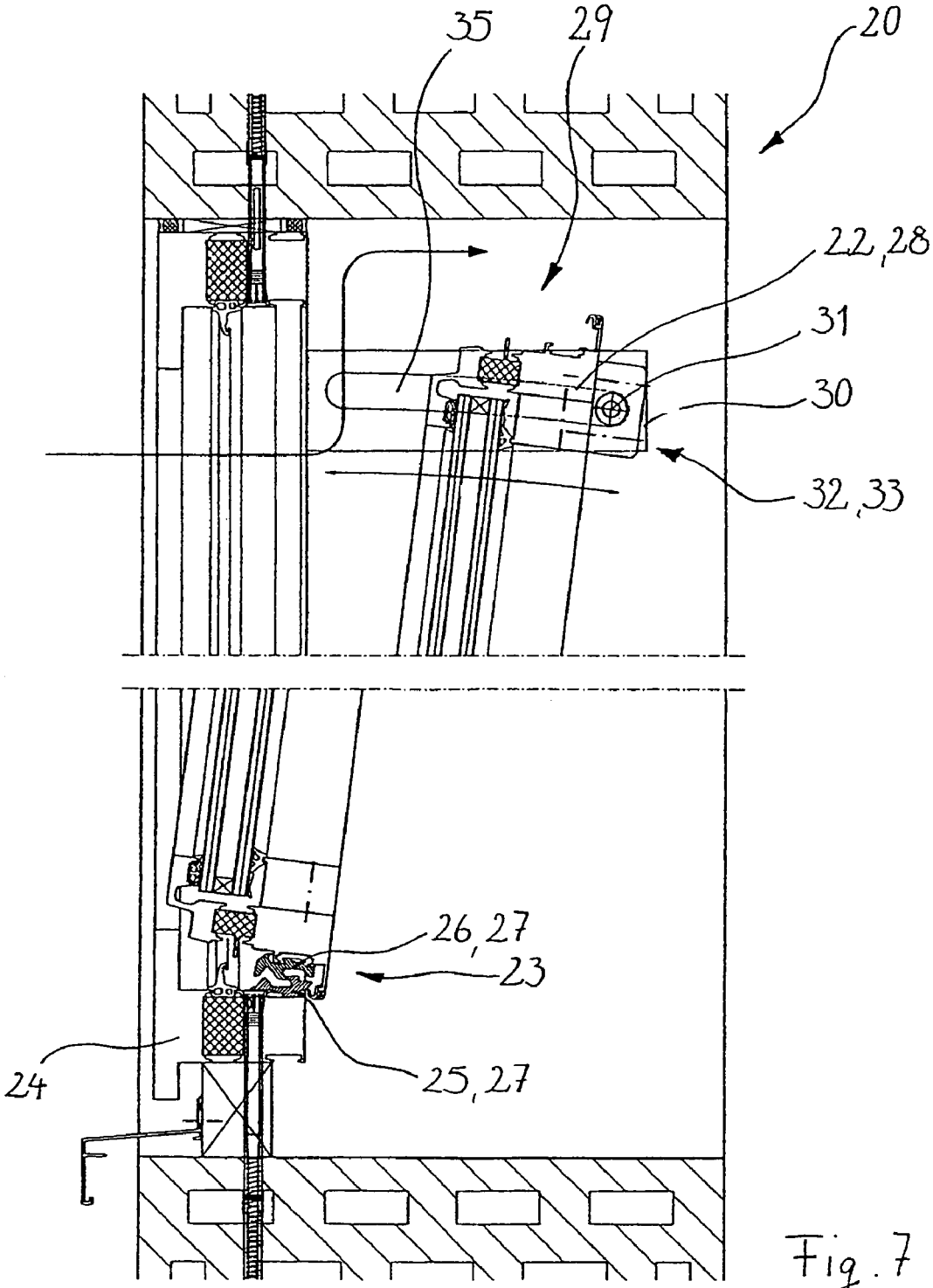
FIG. 7 shows a vertical section in tilted condition.

Sash frame 3' is mounted on a lower frame leg 16' of window frame 2' by means-of articulated joints in the form of hinge strips 4', which joints are not illustrated in more detail but are generally known. In addition to this mounting, an angle profile 17' is disposed on a lower frame leg 18' of sash frame 3' that accommodates the pivotal joints, and an angle profile 19' oriented at an offset of 180° is disposed on frame leg 16' of window frame 2'. The two angle profiles 17' and 19', which are L-shaped in cross section, extend substantially over the entire length of frame legs 16' and 18' respectively and are then mutually braced with their vertically oriented support legs 20' and 21' when sash frame 3' is disposed in tilt-limit position, as illustrated in FIG. 2*b'*. The two angle profiles 17' and 19' have horizontally aligned fastening legs 22', 23' respectively, which are fastened in a manner not illustrated in more detail, for example by means of bolts, to parts of frame legs 16' and 18' having sufficiently large dimensions.

The angle between support leg 20' and fastening leg 22' of angle profile 17' is smaller than 90° , to ensure that the two support legs 20' and 21' bear flat against one another, or in other words run parallel to one another, in the maximum tilt-limit position of sash frame 3'. The angular difference relative to 90° corresponds to the opening angle of sash frame 3' as limited by stop face 12'.

An upper part of the opening cross section—which is rectangular at the top and wedge-shaped at the sides—exposed by sash frame 3' in its tilt-limit position is covered with a perforated plate 24'. This is evident in particular from FIG. 3'. Perforated plate 24' has two bent-over edge strips 25' on its narrow sides and one bent-over edge strip 26' on its long side, the said strips covering upper strap 9' and connecting strut 10' between upper strap 9' and lower strap 8'. Perforated plate 24' extends parallel to upper strap 9' into a region above window frame 2', and anchor 14' is driven through matching bores both in this plate and in upper strap 9'. In this way, perforated plate 24' is connected very firmly to window frame 2', but in addition is also connected to upper strap 9' and connecting strut 10' by bolts and/or rivets, which are not illustrated in more detail. In the event of an explosion shock on the side of window 1' exposed to such a shock (marked by arrow 27') and of a resulting pressure rise, the perforated plate causes, in the region of the largest opening width of the gap formed in tilt-limit position of sash frame 3', attenuation of the pressure rise in the interior of the building by virtue of the throttling openings, without the danger—by virtue of the secure fastening—that the perforated plate will be torn away by the pressure wave. From the horizontal section through window 1' above retaining devices 7' as shown in FIG. 3', it is evident that the two retaining devices 7' are disposed at a certain lateral distance from the window line. Upper strap 9' has a somewhat smaller width than does lower strap 8'.

It is self-evident that the design of inventive window 1' described in the foregoing practical example, with a sash frame 3' in the form of a tilting sash, can also be modified in the respect that, for example, the sash frame protected in the inventive manner is a turning sash. In this case, retaining devices 7' are each horizontally oriented and disposed vertically one above the other on one side of the associated window frame, limiting the opening angle to the specified range of between 5° and 50°, or in the present case to about 10°. In order to be able to override the limitation on opening angle in such a construction of sash frames with vertical axis of rotation, the retaining device can be made of demountable type, so that it can be removed temporarily, for example for the purposes of cleaning the window, and so that the turning sash—or even a tilting sash—can be swiveled briefly by 90° or 180°.

Accordingly, while only a few embodiments of the present invention have been shown and described, it is obvious that many changes and modifications may be made thereunto without departing from the spirit and scope of the invention.

What is claimed is:

1. An explosion-resistant window, comprising:

a window frame;

a sash frame which accommodates a panel made of armored glass, said sash frame being mounted on hinges on the window frame, so as to be tiltable around at least one axis, the sash frame nesting in the window frame in a closed position;

at least one tilt-limiting element that limits explosion-induced tilting of the sash frame in the hinges beyond a tilt-limit position; and at least one shift-limiting element that resists detonation-induced shifting of the sash frame perpendicular to a tilt axis in the hinges, wherein the tilt limiting element comprises a safety scissors mechanism that has been strengthened, said scissors mechanism being mounted in the window frame and in the sash frame, with the safety scissors mechanism engaging with a pin in a hollow profile which is rigidly connected to a steel filling incorporated in the sash frame, said hollow profile and steel filling being displaceable together relative to the sash frame in a direction parallel to the tilt axis of said sash frame; and wherein a nose is formed on a side of the sash frame facing the tilt axis, which nose, in the tilt limiting position of the window frame, engages from behind with a female coupling connected to the window frame such that said nose prevents movement of the sash frame in a direction substantially parallel to the plane of the panel and perpendicular to the tilt axis.

2. A window according to claim 1, wherein at least one of the shift-limiting elements is two-piece and is disposed in the tilt axis and is provided with a female coupling connected to the window frame and with a male coupling connected to the sash frame, the female coupling and the male coupling being provided with hook-like interlocking elements, wherein shifting in tilt-limit position and in any position between this and closed position can be resisted by the fact that the interlocking elements formed on the female coupling and male coupling engage in one another.

3. A window according to claim 2, wherein the male coupling is connected to a pushrod attached to the sash frame and is adapted to be shifted therewith along the tilt axis so that the interlocking elements no longer engage in one another in a turned position of the fitting.

4. A window according to claim 1, wherein at least one of the tilt-limiting elements is connected to the window frame or to a window bay, and is disposed on a side of the sash frame located opposite the hinges, and against which element the sash frame is stopped in tilt-limit position.

5. A window according to claim 1, wherein the female coupling connected to the window frame is equipped at its end facing the interior of the room with a nose-shaped interlocking element, said interlocking element at first running perpendicular to the plane of the panel and then parallel thereto and projecting beyond an interlocking element of a male coupling of the sash frame.

* * * * *